US006630859B1

(12) United States Patent
Wang

(10) Patent No.: US 6,630,859 B1
(45) Date of Patent: Oct. 7, 2003

(54) LOW VOLTAGE SUPPLY BAND GAP CIRCUIT AT LOW POWER PROCESS

(75) Inventor: Chien-Fan Wang, Lu Chou (CH)

(73) Assignee: Taiwan Semiconductor Manufacturing Company, Hsin-chu (TW)

( * ) Notice: Subject to any disclaimer, the term of this patent is extended or adjusted under 35 U.S.C. 154(b) by 0 days.

(21) Appl. No.: 10/057,491

(22) Filed: Jan. 24, 2002

(51) Int. Cl.[7] ..... G05F 1/10; G05F 3/02
(52) U.S. Cl. ..... 327/539; 327/542; 323/313
(58) Field of Search ..... 327/530, 538, 327/539–543, 63, 67, 68, 70, 73; 323/313; 330/259

(56) References Cited

U.S. PATENT DOCUMENTS 5,568,045 A * 10/1996 Koazechi ..... 323/314
5,686,823 A 11/1997 Rapp ..... 323/313
5,712,590 A * 1/1998 Dries et al. ..... 327/539
5,867,013 A * 2/1999 Yu ..... 323/314
6,075,407 A 6/2000 Doyle ..... 327/539
6,150,872 A 11/2000 McNeill et al. ..... 327/539
6,411,158 B1 * 6/2002 Essig ..... 327/539

* cited by examiner

*Primary Examiner*—Long Nguyen
(74) *Attorney, Agent, or Firm*—George O. Saile; Stephen B. Ackerman

(57) ABSTRACT

This invention provides a circuit and a method for producing a very low voltage power supply utilizing the band gap technology. The invention provides for a band gap circuit which can operate at a voltage as low as 1.2 volts using a low power process. The circuit makes use of a combination of NMOS and PMOS devices to develop the required voltage biases that allow the circuit to operate at the band gap voltage. This allows the circuit to operate at power supply voltages as low as 1.2 volts.

15 Claims, 2 Drawing Sheets

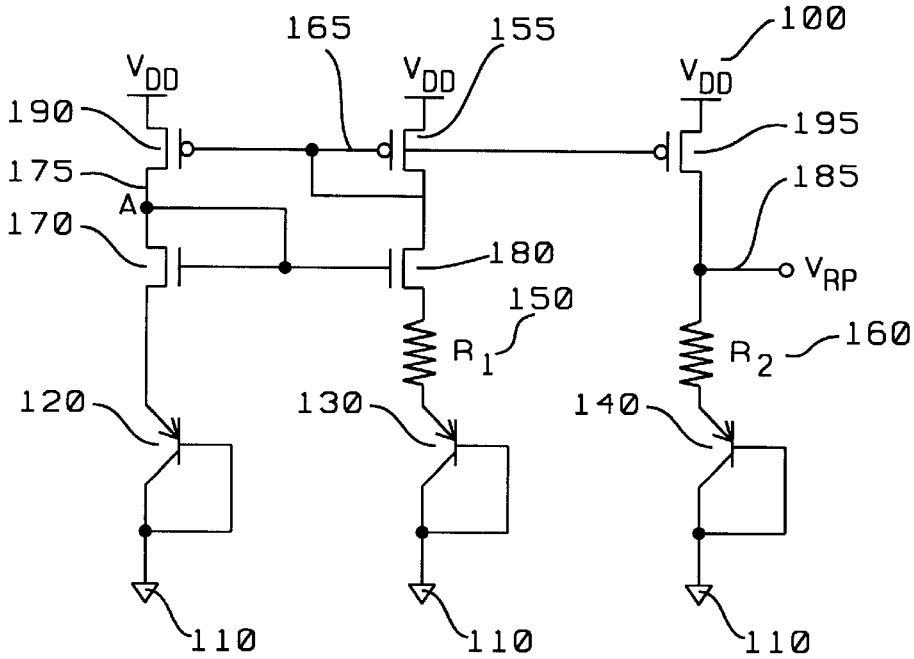
FIG. 1 – Prior Art
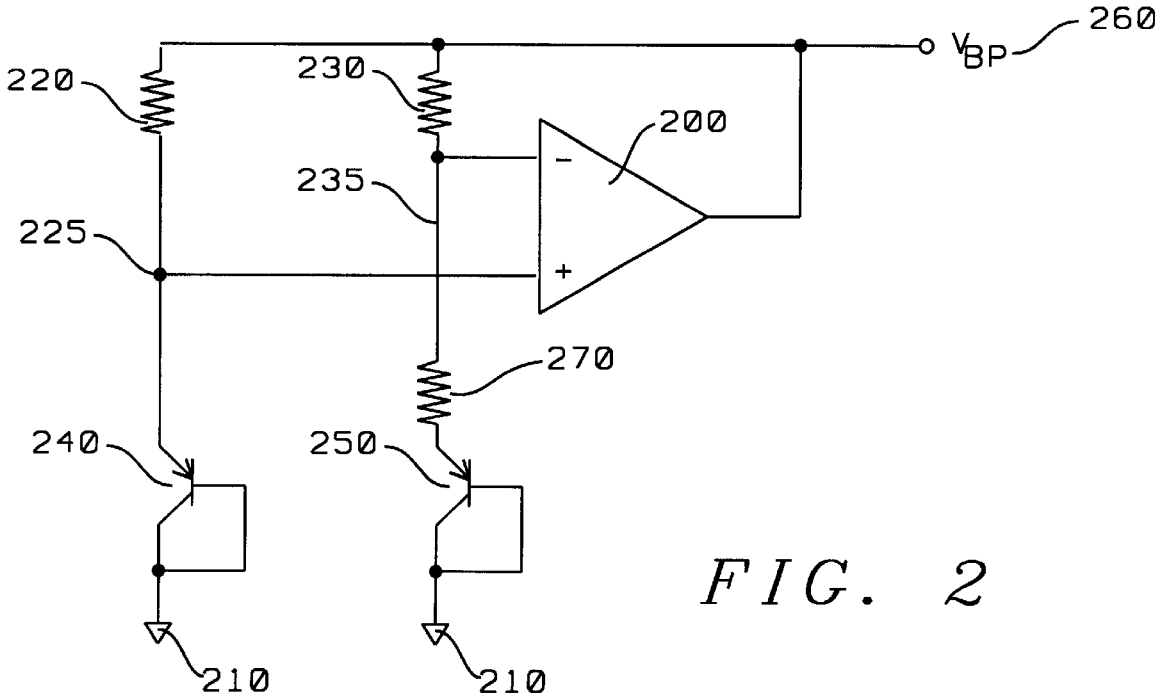
FIG. 2

LOW VOLTAGE SUPPLY BAND GAP CIRCUIT AT LOW POWER PROCESS

BACKGROUND OF THE INVENTION

1. Field of the Invention

This invention relates to a circuit and a method for producing a very low voltage power supply utilizing the band gap technology.

More particularly this invention relates to a band gap circuit which can operate at a voltage as low as 1.2 volts using a low power process.

2. Description of Related Art

FIG. 1 illustrates a conventional current band gap reference circuit. Devices 120, 130 and 140 are bipolar transistors with their bases and collectors shorted together. This results in the creation of PN diodes 120, 130, 140 whose N side is connected to ground 110 in FIG. 1. There are three p-channel MOSFETs in FIG. 1. They are devices 190, 155 and 195. The drains of these devices are connected to the supply voltage, VDD 100. These devices are used as current sources and current mirrors. Devices 170 and 180 are n-channel MOSFETs. They are also used in the current reference and current mirror function of this circuit. Similarly, resistor R1 150 is used to bias the current reference formed by devices 155, 180 and 130. Resistor R2 160 is used to bias the voltage reference formed by devices 195 and 140.

The voltage at node 'A' 175 has to be larger than Vtn+Vbe where Vtn is the threshold of the NMOS (n-channel metal oxide field effect transistor) 170 in FIG. 1 and where Vbe is the base to emitter voltage drop of bipolar transistor connected as a diode 120. In a low power semiconductor manufacturing process, Vtn+Vbe could be close to 1.6 volts at a low temperature condition. This higher voltage level makes this circuit unsuitable for the low voltage, low power applications of today.

U.S. Pat. No. 5,686,823 (Rapp) "Bandgap Voltage Reference Circuit" describes a circuit comprising a feedback controlled current mirror, a band gap voltage generator, and a voltage comparator. This bandgap voltage reference circuit generates a bandgap voltage reference and a current mirror reference while operating over a wide power supply voltage range and down to very low power supply voltage levels.

U.S. Pat. No. 6,075,407 (Doyle) "Low Power Digital CMOS Compatible Bandgap Reference" describes a band gap reference that is compatible with a low voltage CMOS process. It utilizes ratioed current mirrors to provide loop gain and to minimize the offset sensitivity of the loop amplifier.

U.S. Pat. No. 6,150,872 (McNeil et al.) "CMOS Bandgap Voltage Reference" shows a band gap voltage reference circuit for 0.35 micron, 3-volt CMOS technology. This circuit operates in an essentially temperature independent manner and having low supply voltages.

BRIEF SUMMARY OF THE INVENTION

It is the objective of this invention to provide a circuit and a method for producing a very low voltage power supply utilizing the band gap technology.

It is further an object of this invention to produce a band gap circuit which can operate at a voltage as low as 1.2 volts using a low power process.

The objects of this invention are achieved by a low voltage supply band gap circuit made up of a PN diode 'A' whose N side is connected to ground and whose P side is connected to the plus input of a differential voltage comparator, a PN diode 'B' whose N side is connected to ground and whose P side is connected to one node of a series resistor. The series resistor whose other node is connected to the minus input of a differential voltage comparator, differential voltage comparator, a resistor 'C' which is connected to the output of said differential voltage comparator and to the plus input of said differential voltage comparator, a resistor 'D' which is connected to the output of said differential voltage comparator and to the minus input of said differential voltage comparator.

The objects of this invention are further achieved by a a method of providing a low voltage supply band gap circuit made up of the steps of connecting a PN diode 'A' whose N side is connected to ground and whose P side is connected to the plus input of a differential voltage comparator, connecting a PN diode 'B' whose N side is connected to ground and whose P side is connected to one node of a series resistor, and connecting said series resistor whose other node is connected to the minus input of a differential voltage comparator. In addition, the method steps include connecting the differential voltage comparator, connecting a resistor 'C' which is connected to the output of the differential voltage comparator and to the plus input of the differential voltage comparator, and connecting a resistor 'D' which is connected to the output of the differential voltage comparator and to the minus input of the differential voltage comparator.

BRIEF DESCRIPTION OF THE DRAWINGS

FIG. 1 shows a prior art current band gap circuit frequently used.

FIG. 2 shows a general schematic of the band gap power supply circuit of this invention using an operational amplifier representation.

DETAILED DESCRIPTION OF THE INVENTION

Figure 3:
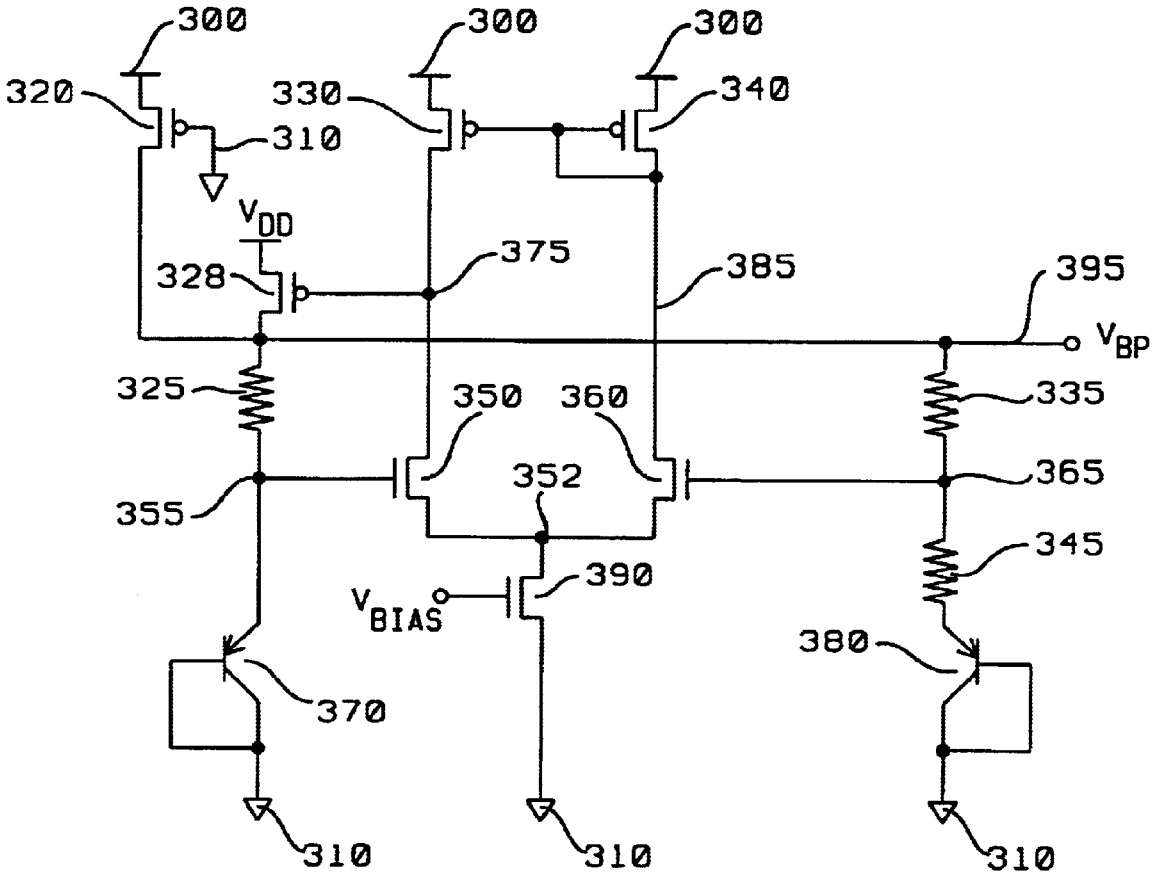
FIG. 3 shows a more detailed schematic of the band gap power supply circuit of this invention.

FIG. 2 shows a general schematic of the invention. A PN diode 240 whose N side is connected to ground has its P side connected to the plus input 225 of the differential voltage comparator circuit 200. The PN diode 240 is made by connecting the base to the collector of a bipolar transistor. A second PN diode 250 whose N side is connected to ground has its P side connected to the minus input 235 of the differential voltage comparator circuit 200.

The differential voltage comparator circuit 200 has two primary inputs, a plus input 225 and a minus input 235. The differential voltage comparator circuit has one primary output 260. The magnitude of this comparator output voltage is directly proportional to the magnitude of the difference between the voltage at the plus input 225 and the minus input 235. The output 260 of the differential voltage comparator 200 connects to a resistor 220. The other node of this resistor 220 connects to the plus input of the differential voltage comparator 200.

The output 260 of the differential voltage comparator 200 also connects to another resistor 230. The other node of this resistor is connected to the minus input of the differential voltage comparator 200.

The function of the differential voltage comparator is via high gain to amplify the difference in the voltage between its plus and minus inputs 225, 235 to produce a voltage output Vbp 260. The increase in Vbp 260 would increase the voltage drop across the resistor 270. Any increase in voltage Vbp is proportionally distributed across resistors 230 and 270. The increase in voltage across resistor 270 results in a higher voltage at node 235. Similarly, the voltage at node 225 is virtually constant, since it is determined by the Vbe drop of PN diode 240. Therefore, if the voltage of the plus node 225 remains the same and the voltage at the minus node 235 increases, the voltage at the minus node 235 approaches the voltage of the plus node 225. Therefore, the overall voltage difference between the plus and minus primary inputs to the differential voltage comparator 200 decreases. Therefore, as seen from the feedback mechanism described above, the differential voltage comparator circuit works to minimize the voltage differences between the plus 225 and minus nodes 235. This contributes to the voltage stability of the low voltage band gap power supply of this invention.

FIG. 3 shows a more detailed embodiment than the circuit of FIG. 2. A PN diode 370 whose N side is connected to ground 310 has its P side connected to the the gate of an NMOS FET device 350 and to a resistor 325. The other side of resistor 325 is connected to the output node Vbp 395. The PN diode 370 is made by connecting the base to the collector of a bipolar transistor.

A second PN diode 380 whose N side is connected to ground 310 has its P side connected to the a resistor 345. The PN diode 380 is made by connecting the base to the collector of a bipolar transistor. The other side of resistor 345 is connected to the gate of an NMOS FET device 360 and to another resistor 335. The other side of resistor 335 is the output node, Vbp 395.

NMOS device 390 has a gate input called Vbias. The drain of NMOS device 390 is connected to the commonly connected sources of NMOS FET devices 350 and 360 at node 352.

PMOS devices 320, 328, 330, 340 have their sources connected to the supply voltage 300. The drain of PMOS device 320 is connected to the output node Vbp 395.

There are some difficulties to implement this circuit. If the inputs of the differential amplifier are connected to PMOS, Vdd−Vtp−Vbe has to be larger than 0 to make it work. Thus, this circuit suffers the same problem (two Vt drops) as the conventional art. If the inputs are connected to NMOS devices, this circuit will go to another balance point, which is much lower than the band gap bias. In this invention, a weak PMOS is used to pull up the bias point. Therefore, it is okay to connect the inputs to NMOS and this circuit is self-biased to the band gap reference voltage. The circuit of the invention can function even with a power supply as low as 1.2 volts with a low voltage process.

This invention has the advantage of being able to operate at the very lowest voltage levels, such as 1.2 volts. The circuit uses a resistor to replace a MOS current source. In addition, the circuit uses a PMOS device to make the circuit bias stable.

While this invention has been particularly shown and described with —reference— to the preferred embodiments thereof, it will be understood by those —skilled— in the art that various changes in form and details may be made without —departing— from the spirit and scope of this invention.

What is claimed is:

1. A low voltage supply band gap circuit, which uses NMOS and PMOS device bias, comprising:

a first PN diode whose N side is connected to ground and whose P side is connected to the gate of an N-channel MOSFET which forms a plus input of a differential voltage comparator, a second PN diode whose N side is connected to ground and whose P side is connected to one node of a first resistor, said first resistor whose other node is connected to the gate of another N-channel MOSFET which forms a minus input of the differential voltage comparator, a bias NMOS FET whose drain is connected in common to the sources of both said NMOS FET and said another NMOS FET of said differential voltage comparator, a second resistor which is connected to an output of said differential voltage comparator and to the plus input of said differential voltage comparator, a third resistor which is connected to the output of said differential voltage comparator and to the minus input of said differential voltage comparator, a first PMOS FET whose drain is connected to said second resistor and whose gate is connected to ground and whose source is connected to a voltage supply, a second PMOS FET whose drain is connected to said second resistor and whose gate is connected to the drain of said NMOS FET and whose source is connected to the voltage supply, a third PMOS FET whose drain is connected to the drain of said NMOS FET and whose gate is connected to the drain of said another NMOS FET and whose source is connected to the voltage supply, a fourth PMOS FET whose gate and drain are connected to the drain of said another NMOS FET and whose source is connected to the voltage supply.

2. The low voltage supply band gap circuit of claim 1 wherein said first PN diode is made up of a first PNP transistor whose base is shorted to its collector.

3. The low voltage supply band gap circuit of claim 1 wherein said second PN diode is made up of a second PNP transistor whose base is shorted to its collector.

4. The low voltage supply band gap circuit of claim 1 wherein said first resistor which is connected in series with said second PN diode is used to develop a voltage level at the minus input of said differential voltage comparator.

5. The low voltage supply band gap circuit of claim 1 wherein said second resistor has nodes which are connected to the output of said differential voltage comparator and to the plus input of said differential voltage comparator.

6. The low voltage supply band gap circuit of claim 1 wherein said third resistor has nodes which are connected to the output of said differential voltage comparator and to the minus input of said differential voltage comparator.

7. The low voltage supply band gap circuit of claim 1 wherein said differential voltage comparator has two primary inputs which are said plus and minus inputs.

8. The low voltage supply band gap circuit of claim 7 wherein said two primary inputs of said differential voltage comparator are compared so as to detect the difference in voltage magnitude.

9. The low voltage supply band gap circuit of claim 1 wherein said differential voltage comparator has one primary output.

10. The low voltage supply band gap circuit of claim 9 wherein the magnitude of said primary output of the differential voltage comparator is directly proportional to the magnitude of the difference of said plus and minus inputs of said differential voltage comparator.

11. The low voltage supply band gap circuit of claim 1 wherein said first PMOS FET is used for pull-up for bias stability for said differential voltage comparator.

12. The low voltage supply band gap circuit of claim 1 wherein said second PMOS FET is used for pull-up for bias stability for said differential voltage comparator.

13. The low voltage supply band gap circuit of claim 1 wherein said third PMOS FET is used for pull-up for bias stability for said differential voltage comparator.

14. The low voltage supply band gap circuit of claim 1 wherein said fourth PMOS FET is used for pull-up for bias stability for said differential voltage comparator.

15. A method of providing a low voltage supply band gap circuit, which uses NMOS and PMOS device bias, comprising the steps of:

connecting a first PN diode whose N side is connected to ground and whose P side is connected to the gate of an N-channel MOSFET which forms a plus input of a differential voltage comparator, connecting a second PN diode whose N side is connected to ground and whose P side is connected to one node of a first resistor, connecting the other node of said first resistor to the gate of another N-channel MOSFET which forms a minus input of the differential voltage comparator, connecting a bias NMOS FET whose drain is connected in common to the sources of both said NMOS FET and said another NMOS FET of said differential voltage comparator, connecting a second resistor which is connected to an output of said differential voltage comparator and to the plus input of said differential voltage comparator, connecting a third resistor which is connected to said output of said differential voltage comparator and to the minus input of said differential voltage comparator, connecting a first PMOS FET whose drain is connected to said second resistor and whose gate is connected to ground and whose source is connected to a voltage supply, connecting a second PMOS FET whose drain is connected to said second resistor and whose gate is connected to the drain of said NMOS FET and whose source is connected to the voltage supply, connecting a third PMOS FET whose drain is connected to the drain of said NMOS FET and whose gate is connected to the drain of said another NMOS FET and whose source is connected to the voltage supply, and connecting a fourth PMOS FET whose gate and drain are connected to the drain of said another NMOS FET and whose source is connected to the voltage supply.

* * * * *

UNITED STATES PATENT AND TRADEMARK OFFICE

CERTIFICATE OF CORRECTION

PATENT NO. : 6,630,859 B1
DATED : October 7, 2003
INVENTOR(S) : Chien-Fan Wang

It is certified that error appears in the above-identified patent and that said Letters Patent is hereby corrected as shown below:

Title page,
Item [75], Inventors, delete "Chien-Fan Wang, Lu Chou (CH)", and replace with -- Chien-Fan Wang, Lu Chou (Taiwan) --.

Signed and Sealed this

Seventeenth Day of February, 2004

JON W. DUDAS
*Acting Director of the United States Patent and Trademark Office*